US011002062B1

(12) United States Patent
Mazur et al.

(10) Patent No.: US 11,002,062 B1
(45) Date of Patent: May 11, 2021

(54) DOOR SILL TOWERS WITH TAPERED BASES

(71) Applicant: WWS Acquisition, LLC, Phoenix, AZ (US)

(72) Inventors: Richard Mazur, Mesa, AZ (US); Cameron Miles Wyatt, Gilbert, AZ (US)

(73) Assignee: WWS Acquisition, LLC, Phoenix, AZ (US)

( * ) Notice: Subject to any disclaimer, the term of this patent is extended or adjusted under 35 U.S.C. 154(b) by 0 days.

(21) Appl. No.: 16/751,098

(22) Filed: Jan. 23, 2020

Related U.S. Application Data

(60) Provisional application No. 62/802,500, filed on Feb. 7, 2019.

(51) Int. Cl.
*E06B 7/14* (2006.01)
*E06B 1/70* (2006.01)

(52) U.S. Cl.
CPC . *E06B 1/70* (2013.01); *E06B 7/14* (2013.01)

(58) Field of Classification Search
CPC ... E06B 7/26; E06B 1/702; E06B 7/14; E06B 1/70; E06B 1/34; E06B 1/003; E06B 1/705; E06B 2001/707; E05Y 2900/132
USPC ..... 52/204.5, 209, 210, 656.5, 62, 202, 211, 52/215, 656.4, 198, 204.52, 204.71; 49/410, 411, 408, 74.1, 91.1, 467, 471
See application file for complete search history.

(56) References Cited

U.S. PATENT DOCUMENTS

| | | | | |
|---|---|---|---|---|
| 6,138,413 | A * | 10/2000 | Fehr | E06B 1/30 49/382 |
| 6,308,475 | B1 * | 10/2001 | Crish, II | E04B 1/0046 49/408 |
| 7,263,808 | B2 * | 9/2007 | Massey | E05C 9/1808 52/204.1 |
| 9,238,934 | B2 * | 1/2016 | Booi | E06B 1/342 |
| 10,060,178 | B2 * | 8/2018 | Seiling | E06B 7/14 |
| 2005/0262771 | A1 * | 12/2005 | Gorman | E06B 7/14 49/408 |
| 2009/0044479 | A1 * | 2/2009 | Martens | E04C 2/288 52/649.3 |
| 2014/0102017 | A1 * | 4/2014 | Booi | E06B 1/52 52/204.1 |
| 2014/0102018 | A1 * | 4/2014 | Rochman | E06B 1/30 52/210 |
| 2015/0096235 | A1 * | 4/2015 | Rochman | E06B 7/14 49/470 |
| 2018/0106095 | A1 * | 4/2018 | Seiling | E06B 7/14 |

* cited by examiner

*Primary Examiner* — Chi Q Nguyen
(74) *Attorney, Agent, or Firm* — Taylor English Duma LLP

(57) ABSTRACT

A door sill including: a sill base including a bottom member and a top member defining a cavity therebetween; and a tower extending from the sill base in a vertical direction and defining a bottom end proximate to the bottom member of the sill base and a top end distal from the bottom member of the sill base and offset from the top member of the sill base, the tower including a first leg and a second leg, a width of the tower where it intersects with the bottom member of the sill base greater than a width of the tower at the top end.

20 Claims, 7 Drawing Sheets

DOOR SILL TOWERS WITH TAPERED BASES

REFERENCE TO RELATED APPLICATIONS

This application claims the benefit of U.S. Provisional Application No. 62/802,500, filed Feb. 7, 2019, which is hereby specifically incorporated by reference herein in its entirety.

TECHNICAL FIELD

Field of Use

This disclosure relates to door sills. More specifically, this disclosure relates to door sills with weeping or moisture removal systems.

Related Art

Door systems used to separate indoor (or interior) and outdoor (or exterior) spaces can collect moisture in one form or another—e.g., rain and dew or condensation—that at some point may desirably be removed or channeled outside of the structure in which the door system is installed. Without a "weep" or moisture removal system, the resulting accumulation of water can cause degradation of the door system or the surrounding structure or create other issues. A separate system for removal of moisture can add to the cost and complexity of the door system and the surrounding structure or both, and such systems generally can be difficult to manufacture cost-effectively while still meeting wind load and other user requirements.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a door sill comprising: a sill base comprising a bottom member and a top member defining a cavity therebetween; and a tower extending from the sill base in a vertical direction and defining a bottom end proximate to the bottom member of the sill base and a top end distal from the bottom member of the sill base and offset from the top member of the sill base, the tower comprising a first leg and a second leg, a width of the tower where it intersects with the bottom member of the sill base greater than a width of the tower at the top end.

In a further aspect, disclosed is a door system comprising: a door sill comprising: a sill base comprising a bottom member and a top member together defining a cavity therebetween; a first tower extending from the sill base in a vertical direction and defining a bottom end proximate to the bottom member of the sill base and a top end distal from the bottom member of the sill base and offset from the top member of the sill base, the first tower comprising a first leg and a second leg, a width of the first tower where it intersects with the bottom member of the sill base greater than a width of the first tower at the top end; a second tower extending from the sill base in a vertical direction and defining a bottom end proximate to the bottom member of the sill base and a top end distal from the bottom member of the sill base, the second tower comprising a first leg and a second leg, a width of the second tower where it intersects with the bottom member of the sill base greater than a width of the second tower at the top end of the second tower; and a sliding door positioned between the first tower and the second tower.

In yet another aspect, disclosed is a method of forming a weep system in a door sill, the method comprising: forming a door sill comprising: a sill base comprising a bottom member and a top member together defining a cavity therebetween; and a tower extending from the sill base in a vertical direction and defining a bottom end proximate to the bottom member of the sill base and a top end distal from the bottom member of the sill base, the tower comprising a first leg and a second leg, a width of the tower where it intersects with the bottom member of the sill base greater than a width of the tower at the top end; forming a first opening in a horizontal surface of the door sill, the first opening extending from the top member of the sill base to the bottom member of the sill base.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
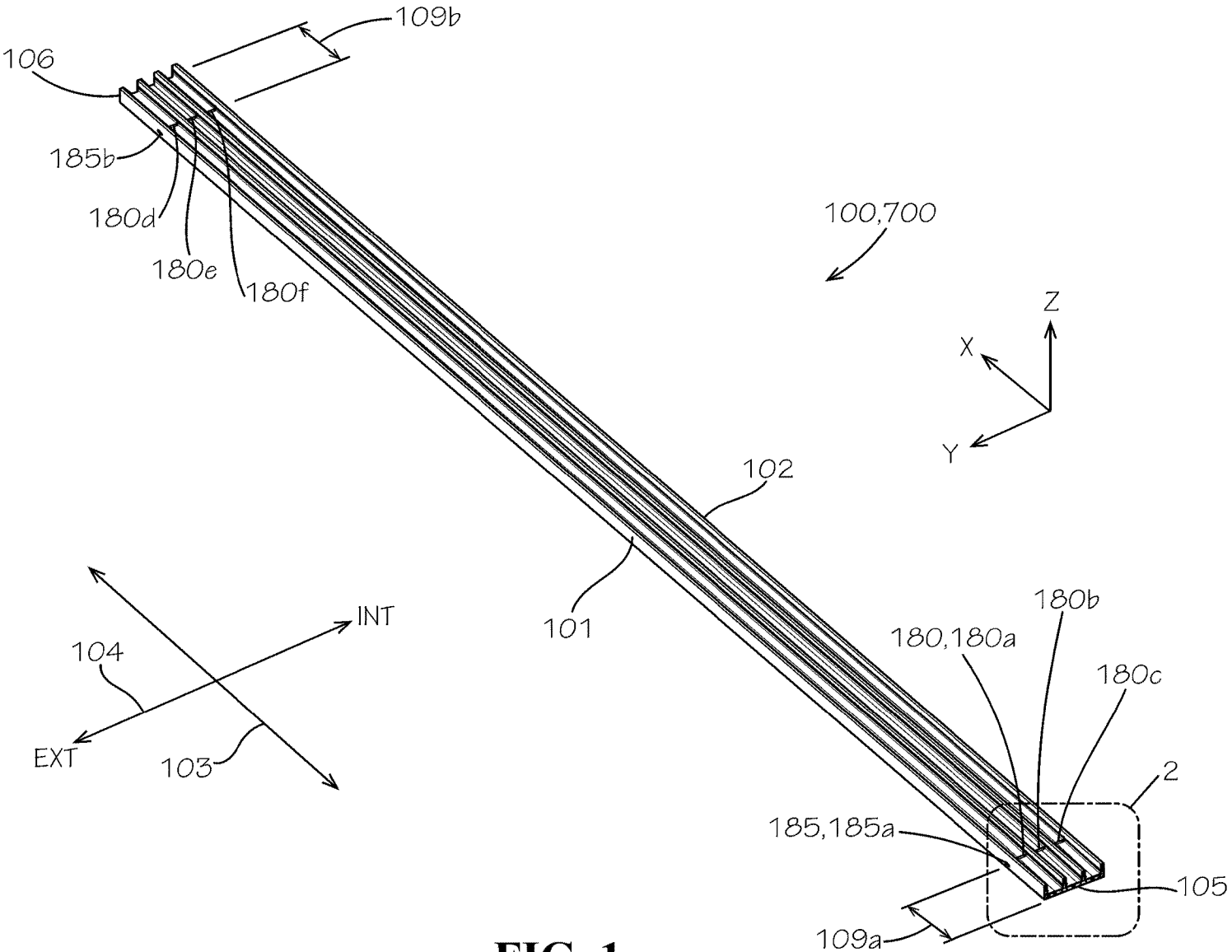
FIG. 1 is a perspective view of a door sill in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "outside" describes that side of the door sill nearest to the outside of the door system and the structure in which the door system is installed; "inside" is that end of the door sill that is opposite or distal the outside; "left," "left end," of "first end" is that which is to the left of or facing left from a person facing towards the outside direction; and "right" is that which is to the right of or facing right from the perspective of a person facing towards the outside direction. "Horizontal" or "horizontal orientation" describes that which is in a plane extending from left to right and aligned with the horizon. "Vertical" or "vertical orientation" describes that which is in a plane that is angled at 90 degrees to the horizontal.

In some aspects, a door sill and associated methods, systems, devices, and various apparatuses are disclosed herein. In some aspects, the door sill can comprise a tower and can define a weep system.

As shown in FIG. 1, a weep system 700 comprising a door sill 100 can define an exterior side 101, an interior side 102, a first end 105, and a second end 106. The door sill 100 can further define a longitudinal direction 103 extending from the first end 105 to the second end 106 and a transverse direction 104 extending from the exterior side 101 to the interior side 102.

The door sill 100 and other aspects of the structures and methods described herein can alternately be described on the basis of a coordinate axis of X-Y-Z directions shown in the figures. An X-axis direction can be referred to as a left-right or horizontal direction running parallel to the longitudinal direction 103. A Z-axis direction can be referred to as an up-down or vertical direction and is orthogonal to the X-axis direction and to a Y-axis direction and typically coincides with a height direction of the door sill 100. The Y-axis direction is orthogonal to the X-axis direction and the Z-axis direction and can also be referred to as an interior-exterior direction.

The door sill 100 can define openings 180*a,b,c*, which can be defined in the door sill 100 proximate to the first end 105. The door sill 100 can similarly define an opening 185*a*, which can also be defined in the door sill 100 proximate to the first end 105. The door sill 100 can define openings 180*d,e,f*, which can be defined in the door sill 100 proximate to the second end 106. The door sill 100 can similarly define an opening 185*b*, which can also be defined in the door sill 100 proximate to the second end 106. Any of the openings 180*a,b,c*, the openings 180*d,e,f*, and the openings 185*a,b* can be offset from the first end 105 or the second end 106 by an offset distance 109*a,b*. In some aspects, as shown, the openings 180*a,b,c* and the openings 180*d,e,f* can be aligned along the transverse direction 104 with the respective openings 185*a,b*. In other aspects, either of the openings 180*a,b,c* and the openings 180*d,e,f* can be offset in the longitudinal direction 103 from the respective openings 185*a,b*. In some aspects, the door sill 100 can define two sets of openings 180—the openings 180*a,b,c* and the openings 180*d,e,f*. In other aspects, the door sill 100 can define more or fewer openings 180. Similarly, in some aspects, the door sill 100 can define two openings 185—the opening 185*a* and the opening 185*b*—or two sets of openings 185. In other aspects, the door sill 100 can define more or fewer openings 185.

Figure 2:
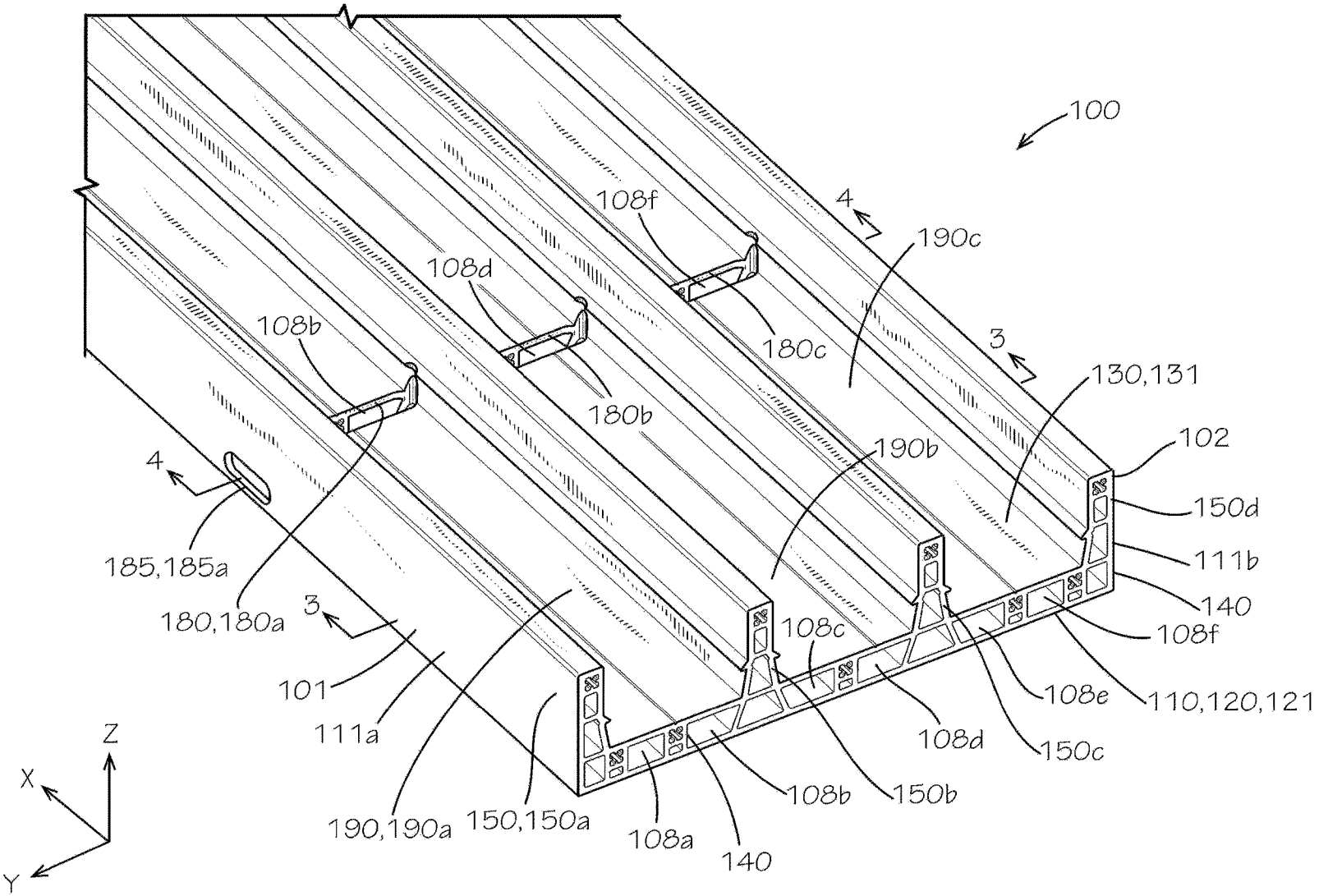
FIG. 2 is a detail perspective view of the door sill of FIG. 1 taken from detail 2 of FIG. 1.

As shown in FIG. 2, the door sill 100 can comprise a sill base 110, which can comprise a bottom member 120 and a top member 130. The bottom member 120 of the sill base 110 can define a lower surface 121, which can be oriented horizontally. The top member 130 of the sill base 110 can define an upper surface 131, which can be oriented horizontally. The sill base 110 can further comprise vertical members 140 (representatively shown in FIG. 2, wherein any structure of the sill base 110 that is oriented vertically can be a vertical member 140), which can extend from the bottom member 120 to the top member 130. As shown, the bottom member 120 and the top member 130 can be positioned parallel to one another and the vertical members 140 can be positioned parallel to each other.

The door sill 100 can further comprise towers 150*a,b,c,d*, which can extend from the sill base 110. In the current aspect, four towers 150 are shown, but the door sill 100 can comprise any number of towers 150—including only a single tower 150—in other aspects as desired. More specifically, in some aspects, the door sill 100 can comprise pairs of towers 150*a,b,c,d* defining door channels 190. For example and without limitation, the door sill 100 can comprise a first tower 150*a* and a second tower 150*b* defining a first door channel 190*a* sized and configured to receive a first door 200*a* (shown in FIG. 3) and associated hardware. Similarly, the second tower 150*b* and a third tower 150*c* can define a second door channel 190*b* sized and configured to receive a second door (not shown) and associated hardware. Similarly, the third tower 150*c* and a fourth tower 150*d* can define a third door channel 190*c* sized and configured to receive a third door (not shown) and associated hardware. The door sill 100 can comprise additional towers 150 and additional door channels 190 to accommodate as many doors as desired and can comprise fewer towers 150 and fewer door channels 190 to accommodate as few doors as desired.

The door sill 100 can define the openings 180*a,b,c*, which can allow and be configured to direct or "weep" water from the respective door channel 190*a,b,c* into a cavity defined in the sill base 110 such as, for example and without limitation, any one of a plurality of cavities 108*a,b,c,d,e,f*. Any one of a plurality of cavities 108*a,b,c,d,e,f* can be defined by the bottom member 120, the top member 130, or the vertical members 140, individually or in combination. Any one of the openings 180*a,b,c* can be defined in the sill base 110 itself, and more specifically in the upper surface 131 of the top member 130. In some aspects, as shown, an opening such as the opening 180*a,b,c* can direct water from the respective door channel 190*a,b,c* to only another area of the door sill 100—for example and without limitation, any one of the openings 180*a,b,c* as described. In other aspects, an opening such as the opening 180*a,b,c* can direct water from the respective door channel 190*a,b,c* to an area outside of the door sill when, for example and without limitation, all or a portion of the opening 180*a,b,c* extends through the bottom member 120 of the door sill 100. The opening 180*a,b,c* can be a first opening.

In some aspects, as shown, each of the openings 180 can define a slot—or a slotted hole—extending lengthwise in the transverse direction 104. In other aspects, any one of the openings 180 can have a different shape—such as, for example and without limitation, a circular or rectangular shape—or can extend in a direction that is angled with respect to the transverse direction 104. For example and without limitation, the opening 180 can have a width in the X-axis direction measuring about ⅜" (9.5 mm) and, as will be described, can be processed or formed in the door sill 100 from the top. In some aspects, an elongated opening such as the openings 180 and the opening 185, can facilitate increased flow of moisture into, through, and from the door sill 100.

The door sill 100 can further define the openings 185, which can allow and be configured to direct or weep water from within the sill base 110—from, for example and without limitation, the cavity 108*a,b,c,d,e,f* of the sill base 110—to an area outside of the sill base 110. In some aspects, as shown, an opening such as the opening 185*a* can direct water from within the door sill 100 to an area outside of the sill base 110 on only one side—for example and without limitation, the exterior side 101 from which water can be expelled. In other aspects, openings can direct water from within the door sill 100 to an area outside of the sill base 110 on additional sides including, for example and without limitation, an interior side 102 from which water can also be expelled. In some aspects, either of the exterior side 101 and the interior side 102 can be a side 101, 102 without a particular exterior or interior orientation. In any case, water can be expelled from openings provided such as the opening 185. Any one of the openings 180*a,b,c* can be defined in any surface of the door channels 190*a,b,c* of the door sill 100 and can extend at least from the upper surface 131 of the top member 130 of the sill base 110 to the bottom member 120 of the sill base 110. The opening 185 can be defined in an outer surface 111*a,b* of the door sill 100, a surface which can be an oriented vertically. The opening 185 can be a second opening.

In some aspects, as shown, each of the openings 185 can define a slot—or a slotted hole—extending lengthwise in the longitudinal direction 103. In other aspects, any one of the openings 185 can have a different shape—such as, for example and without limitation, a circular or rectangular shape—or can extend in a direction that is angled with respect to the transverse direction 104.

Figure 3:
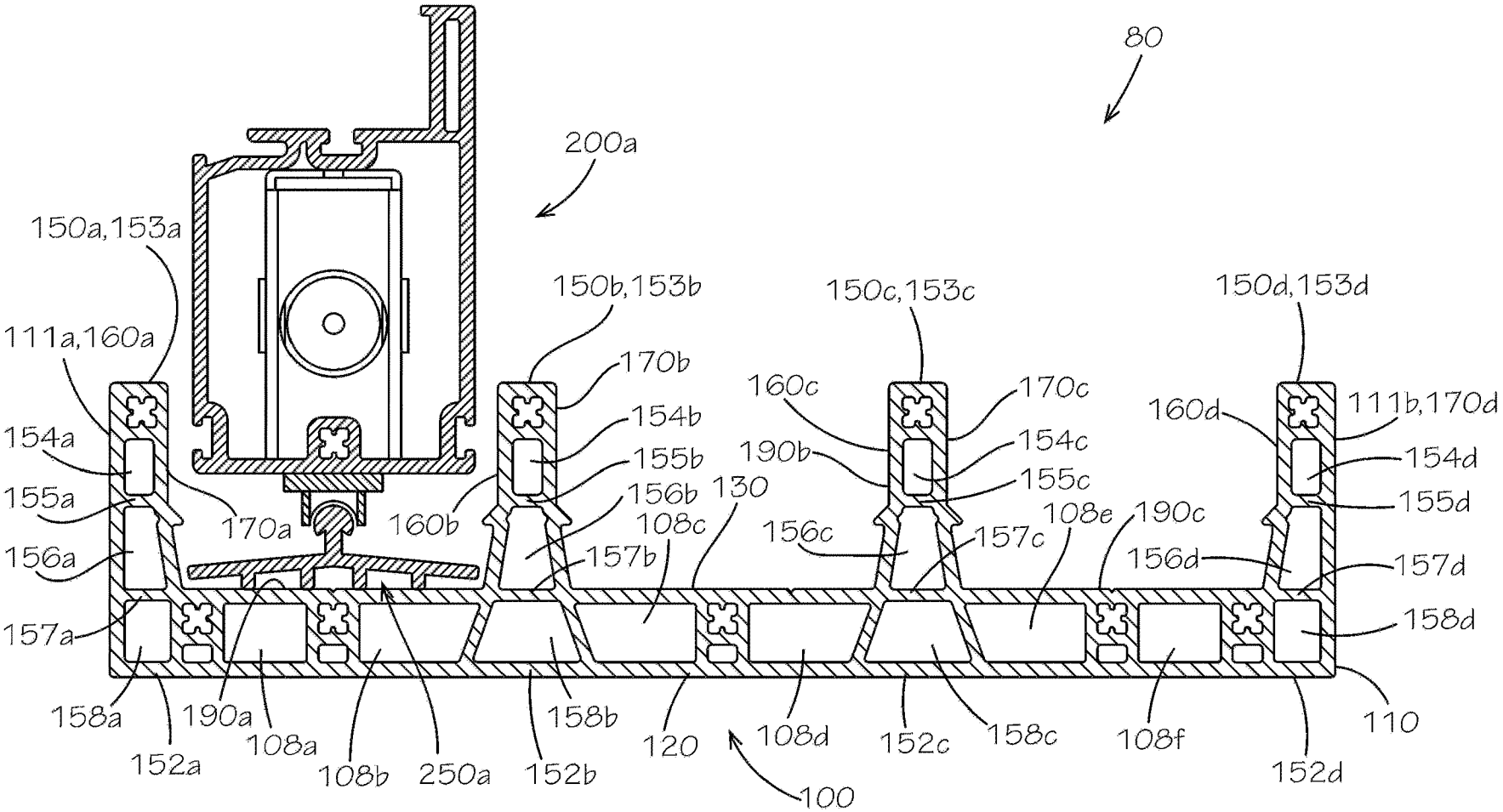
FIG. 3 is a sectional view of a door system comprising a door and a door support and also comprising the door sill of FIG. 1 taken along line 3-3 of FIG. 2.

As shown in FIG. 3, a door system 80 can comprise the door sill 100. The door system 80 can further comprise the door 200*a*. The door system 80 can further comprise a door support 250*a*. Each of the plurality of towers 150*a,b,c,d* can extend from the sill base 110 in a vertical direction and can define a bottom end 152*a,b,c,d* proximate to the bottom member 120 of the sill base 110 and a top end 153*a,b,c,d* distal from the bottom member 120 of the sill base 110. Each of the plurality of towers 150*a,b,c,d* can comprise a first leg 160*a,b,c,d* and a second leg 170*a,b,c,d*. Each of the towers 150*a,b,c,d* can define cavities 154*a,b,c,d*, cavities 156*a,b,c,d*, and cavities 158*a,b,c,d*. The cavities 158*a,b,c,d* can also be described as being defined in the sill base 110. As shown, each of the towers 150*a,b,c,d* and the sill base 110 can define other cavities and other members. In some aspects, the bottom end 152*a,b,c,d* can be aligned with or be considered an extension of the bottom member 120 of the sill base 110.

Defining at least in part one or more of the cavities 154*a,b,c,d*, the cavities 156*a,b,c,d*, and the cavities 158*a,b,c,d* can be cross members 155*a,b,c,d* and cross members 157*a,b,c,d*, which can extend from the first leg 160*a,b,c,d* to the second leg 170*a,b,c,d* of the towers 150*a,b,c,d*. The cross members 155*a,b,c,d* and the cross members 157*a,b,c,d* can, for example and without limitation, provide rigidity to the towers 150*a,b,c,d* and make possible a lighter weight and therefore thinner cross-section than might otherwise be practical. In some aspects, the cross member 157*a,b,c,d* can be aligned with or be considered an extension of the top member 130 of the sill base 110.

A door such as the representative door 200*a* positioned between the first tower 150*a* and the second tower 150*b* can be a sliding door. The door 200*a* can be positioned above and can be supported by the door support 250*a*. A door support such as the door support 250*a* can be positioned above and can be supported by the door channel 190*a* of the door sill 100. Any other door channels such as the door channels 190*b,c* can receive doors (not shown) and door supports (not shown), any of which can vary from the shape and configuration shown for the respective door 200*a* and the respective door support 250*a*.

Figure 4:
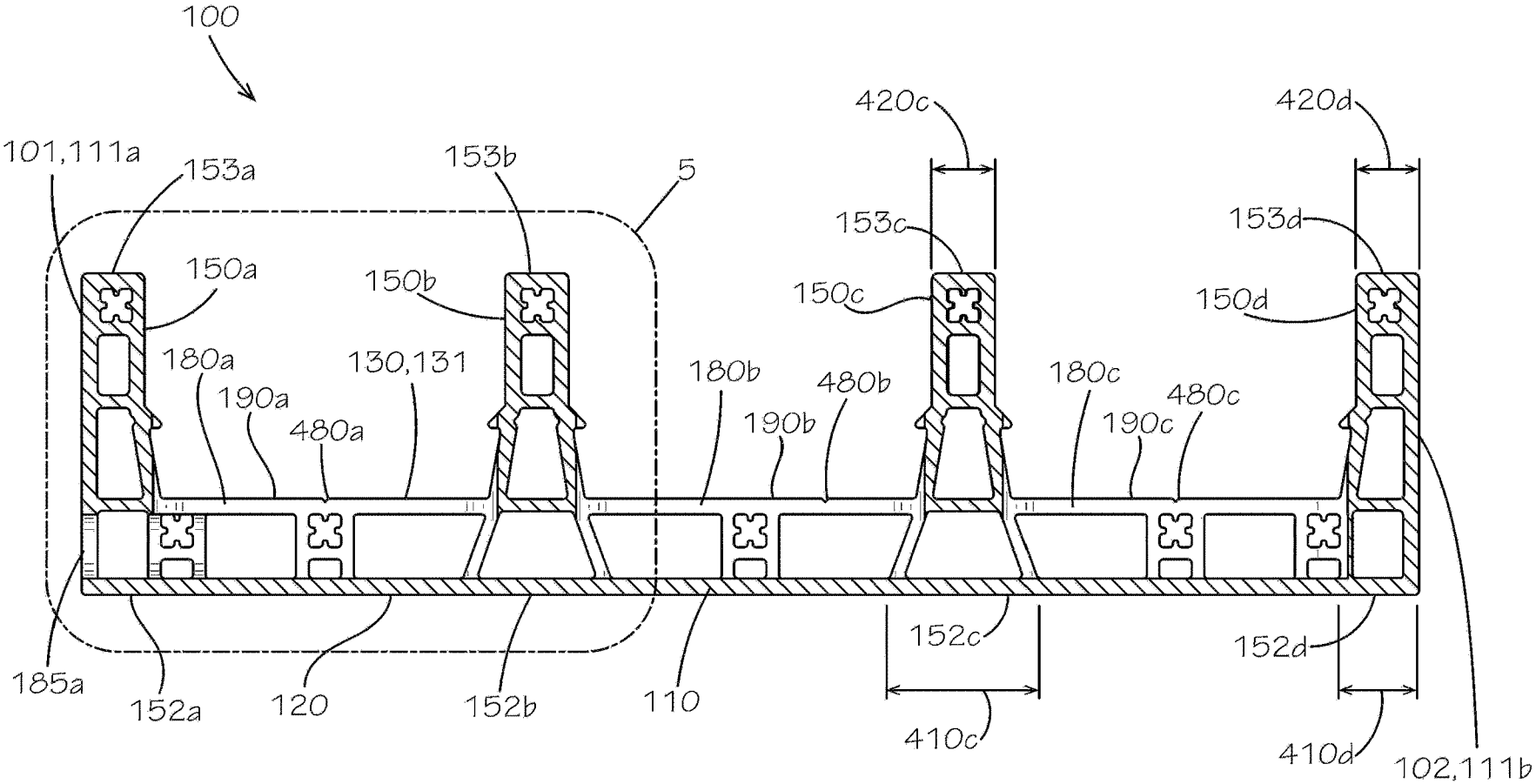
FIG. 4 is a sectional view of the door sill of FIG. 1 taken along line 4-4 of FIG. 2.

As shown in FIG. 4, the opening 185*a* can extend from the outer surface 111*a* towards the opening 180*a* and intersect the opening 180*a*. As shown, at least one of the towers 150*a,b,c,d* can be tapered—and more specifically can be tapered towards the top ends 153*a,b,c,d*, respectively. A width 410*a,b,c,d* (410*a,b* shown in FIG. 5) of a bottom end 152*a,b,c,d* of the respective tower 150*a,b,c,d*, where it can intersect with the bottom member 120 of the sill base 110, can be greater than a corresponding width 420*a,b,c,d* (420*a,b* shown in FIG. 5) of the tower 150*a,b,c,d* at the top end 153*a,b,c,d* of the respective tower 150*a,b,c,d*.

The door sill 100 can define grooves such as, for example and without limitation, the grooves 480*a,b,c* for a purpose such as, in the case of the groove 480*b* as shown, locating fasteners—such as anchor fasteners or, more specifically, anchor screws—to secure the door sill 100 to surrounding structure at anchor locations or, in the case of 480*a,c* as shown, locating strike fasteners in a center of the respective door channels 190*a,b,c*. In some aspects, as with the grooves 480*a,c* as shown, any of the grooves 480*a,b,c* can be defined in the center of the respective door channel 190*a,b,c*. In other aspects, any of the grooves 480*a,b,c* can be offset in the transverse direction 104 from the center of the respective door channel 190*a,b,c*. In some aspects, the door sill 100 can be used only at the bottom of an assembled frame (not shown) defined by the door system 80 (shown in FIG. 3). In other aspects, the door sill 100 can be used also at the top of the door system 80 or around the entire perimeter of the door system 80 (i.e., at the top, at the bottom, and at the sides). In some aspects, any of the grooves 480*a,b,c* can be used as an identifying mark by the manufacturer of the door sill 100.

Figure 5:
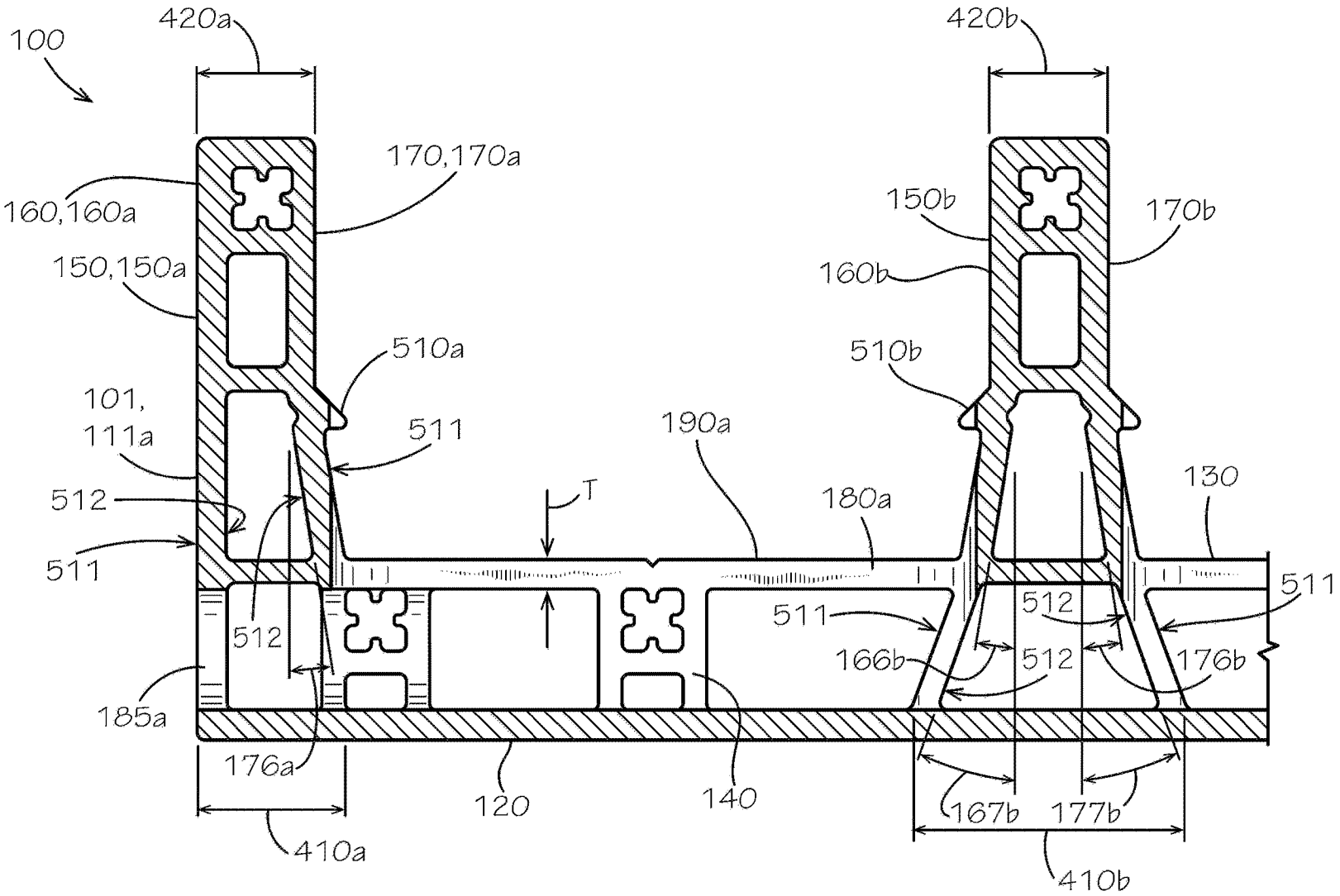
FIG. 5 is a detail sectional view of the door sill of FIG. 1 taken from detail 5 of FIG. 4.

As shown in FIG. 5 (at least with respect to the tower 150*b* and in part with respect to the tower 150*a*), any of the towers 150*a,b,c,d* can define a taper angle 166*a,b,c,d* (166*a* not labeled because the tower 150*a* as shown does not incorporate a taper on the exterior side 101 of the door sill 100 and 166*c,d* corresponding to the towers 150*c,d* also not labeled) measured between a one of an outside surface 511 and an outside surface 512 of the respective leg 160*a,b,c,d* (160*c,d* shown in FIG. 4) or a taper angle 176*a,b,c,d* (176*d* not shown because the tower 150*d* as shown does not incorporate a taper on the interior side 102—shown in FIG. 4—of the door sill 100 and 166*c* and 176*c* corresponding to tower 150*c* also not shown) measured between a one of an outside surface 511 and an outside surface 512 of the respective leg 170*a,b,c,d* (170*c,d* shown in FIG. 4). In some aspects, the taper angle 166*a,b,c,d* can be less than or equal to about 45 degrees. In some aspects, the taper angle 166*a,b,c,d* can be less than or equal to about 40 degrees. In some aspects, the taper angle 166*a,b,c,d* can be less than or equal to about 35 degrees. In some aspects, the taper angle 166*a,b,c,d* can be less than or equal to about 30 degrees. In some aspects, the taper angle 166*a,b,c,d* can be less than or equal to about 25 degrees. In some aspects, the taper angle 166*a,b,c,d* can be less than or equal to about 20 degrees. In some aspects, the taper angle 166*a,b,c,d* can be less than or equal to about 15 degrees. In some aspects, the taper angle 166*a,b,c,d* can be less than or equal to about 10 degrees. In some aspects, the taper angle 166*a,b,c,d* can be less than about 5 degrees. In some aspects, as shown, the taper angle 166*a,b,c,d* can be equal to about 10 degrees.

Also as shown in FIG. 5 (at least with respect to the towers 150*b,c*), any of the towers 150*a,b,c,d* can further define a taper angle 167*a,b,c,d* (167*a,d* corresponding to towers 150*a,d* not labeled because the towers 150*a,d* as shown do not incorporate a taper on the exterior side 101 of the door sill 100) measured between a one of an outside surface 511 and an outside surface 512 of the respective leg 160*a,b,c,d* or a taper angle 177*a,b,c,d* (177*c,d* not labeled) measured between a one of an outside surface 511 and an outside surface 512 of the respective leg 170*a,b,c,d*. In some aspects, the taper angle 176*a,b,c,d* can be less than or equal to about 45 degrees. In some aspects, the taper angle 176*a,b,c,d* can be less than or equal to about 40 degrees. In some aspects, the taper angle 176*a,b,c,d* can be less than or equal to about 35 degrees. In some aspects, the taper angle 176*a,b,c,d* can be less than or equal to about 30 degrees. In some aspects, the taper angle 176*a,b,c,d* can be less than or equal to about 25 degrees. In some aspects, the taper angle 176*a,b,c,d* can be less than or equal to about 20 degrees. In some aspects, the taper angle 176*a,b,c,d* can be less than or equal to about 15 degrees. In some aspects, the taper angle 176*a,b,c,d* can be less than or equal to about 10 degrees. In some aspects, the taper angle 176*a,b,c,d* can be less than about 5 degrees. In some aspects, as shown, the taper angle 176*a,b,c,d* can be equal to about 20 degrees. In some aspects, the taper angle 166*a,b,c,d* or the taper angle 176*a,b,c,d* will be sufficiently large, given a particular wall thickness of the legs 160, 170, as discussed below, for an inside surface of the legs 160, 170 intersecting the openings 180*a,b,c* (180*b,c*, shown in FIG. 4) to be cut through during the forming of the openings 180*a,b,c*.

As shown, each of the towers 150*a,b,c,d* can comprise a rib 510*a,b* extending from the leg 160, 170 facing the corresponding door channel(s) 190*a,b,c* (190*b,c* shown in FIG. 4). The ribs 510*a,b* can function as, for example and without limitation, male snap features for use in securing components such as track, jamb, or channel fillers inside the respective door channels 190.

Each of the legs 160*a,b,c,d* and each of the legs 170*a,b,c,d* of the respective towers 150*a,b,c,d*, each of the bottom member 120 and the top member 130 of the sill base 110, each of the vertical members 140, and any other structural member of the door sill 100, whether identified or not with a reference number, can define a wall thickness T, which can be constant or variable. In some aspects, the wall thickness T of each of the structural members will be approximately equal to each other to facilitate fabrication of the door sill 100. In other aspects, the wall thickness T of at least one of the structural members will be less than or greater than the wall thickness T of other structural members for various reasons such as, for example and without limitation, to reduce weight or provide extra strength, respectively. In some aspects, the wall thickness T of each of the legs 160, 170 can be sufficiently large, given a particular taper angle of the legs 160, 170 such as, for example, any of the taper angles 166*a,b,c,d* or the taper angles 176*a,b,c,d*, as discussed above, for both of the outside surface 511, which can face towards the door channel 190, and the inside surface 512, which can face away from the door channel 190, of the legs 160, 170 intersecting the openings 180*a,b,c* to be cut through during the forming of the openings 180*a,b,c*. In some aspects, a portion of the respective inside surface 512 of the legs 160, 170 proximate to the bottom member 120 can be positioned inboard from or offset from an outermost edge of the opening 180*a* towards a center of the opening 180*a* and relative to the center of the opening.

By tapering the towers 150*a,b,c,d*, the towers 150*a,b,c,d* individually and the door sill 100 overall can more easily withstand certain loads without failure and the openings 180, 185 can be easily formed in the door sill 100. By tapering the towers 150*a,b,c,d*, the top ends 153*a,b,c,d* (shown in FIG. 4) of the towers 150*a,b,c,d* can be made narrower where less strength is typically needed and, in contrast, the bottom ends 152*a,b,c,d* (shown in FIG. 4) of the towers 150 can be made wider where more strength is typically needed. By narrowing the top ends 153*a,b,c,d*, between which the door channels 190*a,b,c* must be sufficiently wide for a door such as the door 200*a* (shown in FIG. 3) to move, and by widening the bottom ends 152*a,b,c,d*, where not such structure exists, an overall width of the door sill 100 can be decreased—allowed the door system 80 (shown in FIG. 3) to fit within a narrower space within a surrounding structure such as a frame of a building, and resistance of the door system 80 to structural damage or failure—due to normal loads and also extreme loads such as might be experienced in a strong weather event or other natural or non-natural event causing the door system 80 to experience loading—can be increased. As disclosed herein, the load from the top of the door sill 100, which can also be described as a portion of a door sash or frame surrounding the doors, can be transferred into the base of the towers 150 and to the bottommost surface of the door sill 100, which can be the bottom member 120, where the door sill 100 can be supported by the surrounding structure. In some aspects, the door system 80 including the door sill 100 will be small enough to fit inside a wall opening formed with 2×4 or 2×6 lumber but meet all applicable strength requirements.

Figure 6:
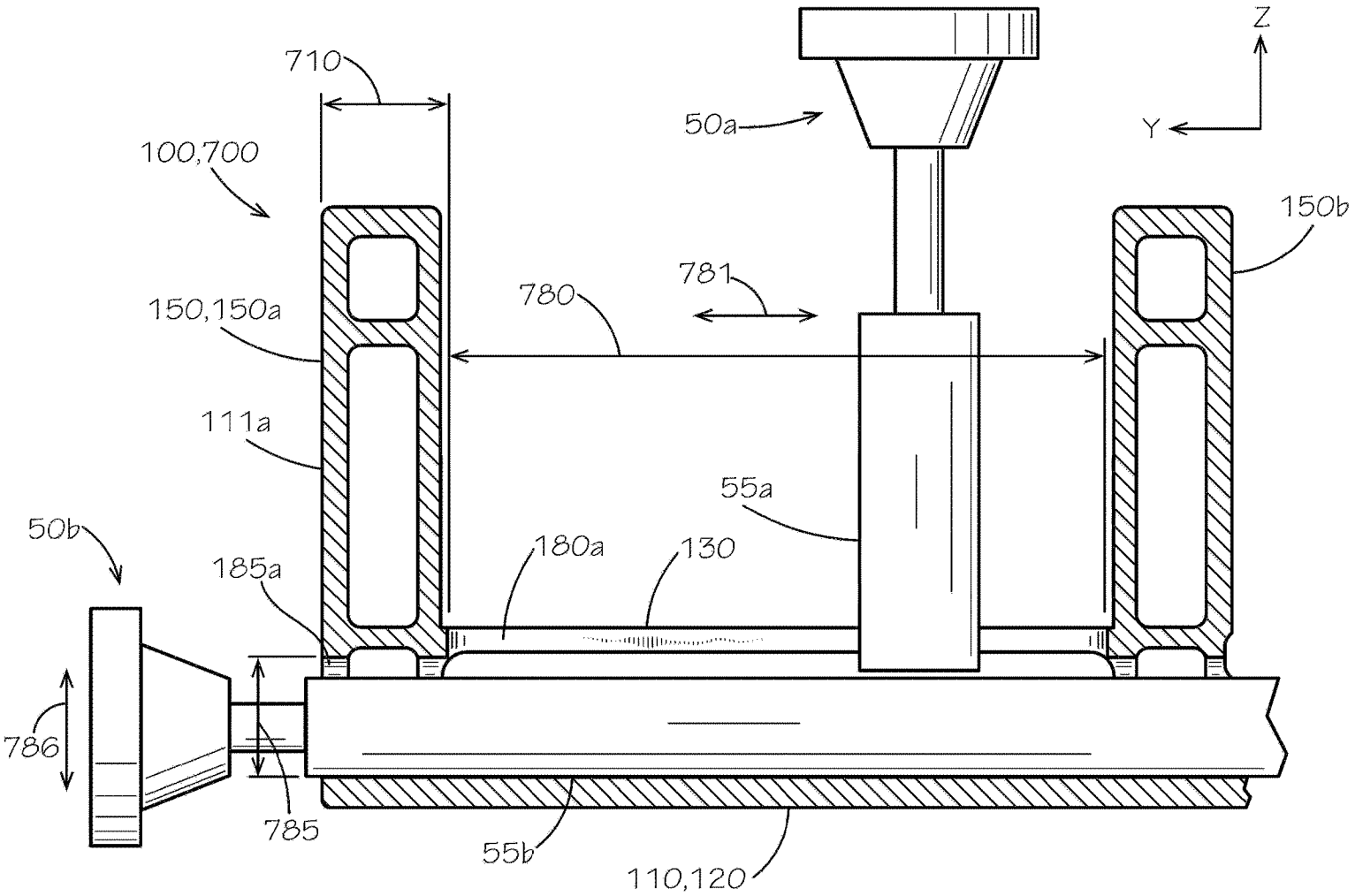
FIG. 6 is a detail sectional view of the door sill of FIG. 1 taken along line 4-4 of FIG. 2 in accordance with another aspect of the current disclosure wherein a plurality of towers of the door sill are not tapered, the door sill shown in a process of fabrication.

As shown in FIG. 6, all of the towers 150 such as, for example and without limitation, the towers 150*a,b* need not be tapered. In such aspects, openings such as the openings 180*a,b,c* (180*b,c* shown in FIG. 4) and the opening 185*a* can still be formed in the door sill 100. In such aspects, however, special tooling such as, for example and without limitation, cutting tools 50*a,b* incorporating multi-axis functionality or custom cutting bits 55*a,b* extending, as shown, long distances through the door sill 100 may be required. Even then, manufacturability may be reduced below acceptable or at least desirable levels when such special tooling is used. For example and without limitation, unusually long tools such as the cutting bit 55*b* that would be required can be more expensive to manufacture, can perform less consistently or create rougher cut surfaces, and can have a shorter life. As shown, cutting the opening 180*a* with the cutting tool 50*a*, which can be a rotating cutting tool, does not form tower leg openings 168*a,b,c,d* (shown in FIG. 7) or tower leg openings 178*a,b,c,d* (also shown in FIG. 7), which can facilitate movement of moisture through and out of the door sill 100. As shown, a separate cutting operation with the cutting tool 50*b* can be necessary in some aspects to form tower leg openings across nearly the entire width of the door still. Otherwise, moisture can be trapped inside at least some portions of the door sill 100 with no path of escape. Were the legs 160*a,b,c,d* (shown in FIG. 3) and the legs 170*a,b,c,d* (shown in FIG. 3) to be removed or severed in the region between the bottom member 120 and the top member 130 of the sill base 110, the movement of moisture could still be impeded and also the strength of the door sill 100, including at the towers 150*a,b,c,d* (150*c,d* shown in FIG. 3), could be reduced below acceptable or desirable levels. Typically, door systems such as the door system 80 (shown in FIG. 3) must generally meet user or local municipal or other government requirements for wind load rating and other load ratings such as might be necessitated by local weather and other use conditions.

As shown, a method of forming the weep system 700 can comprise plunging the cutting bit 55*a* of the cutting tool 50*a* along the Z-axis direction into the door sill 100 and translating the cutting tool 50*a* in the cutting direction 781 across a cutting swath 780 (which can be measured to the outside of the tool as shown or to a center of the cutting bit of the tool) to form the opening 180*a*. Likewise, the method can comprise plunging the cutting bit 55*b* of the cutting tool 50*b* along the Y-axis direction into the door sill 100 and translating the cutting tool 50*b* in a cutting direction 786 across a cutting swath 785 (which can be measured to the outside of the tool as shown or can be measured to a center of the cutting bit of the tool) to form the opening 185*a*. In some aspects, the method can comprise translating either of the cutting tool 50*a,b* in the X-axis direction or along the longitudinal direction 103 (shown in FIG. 1) of the door sill 100.

Figure 7:
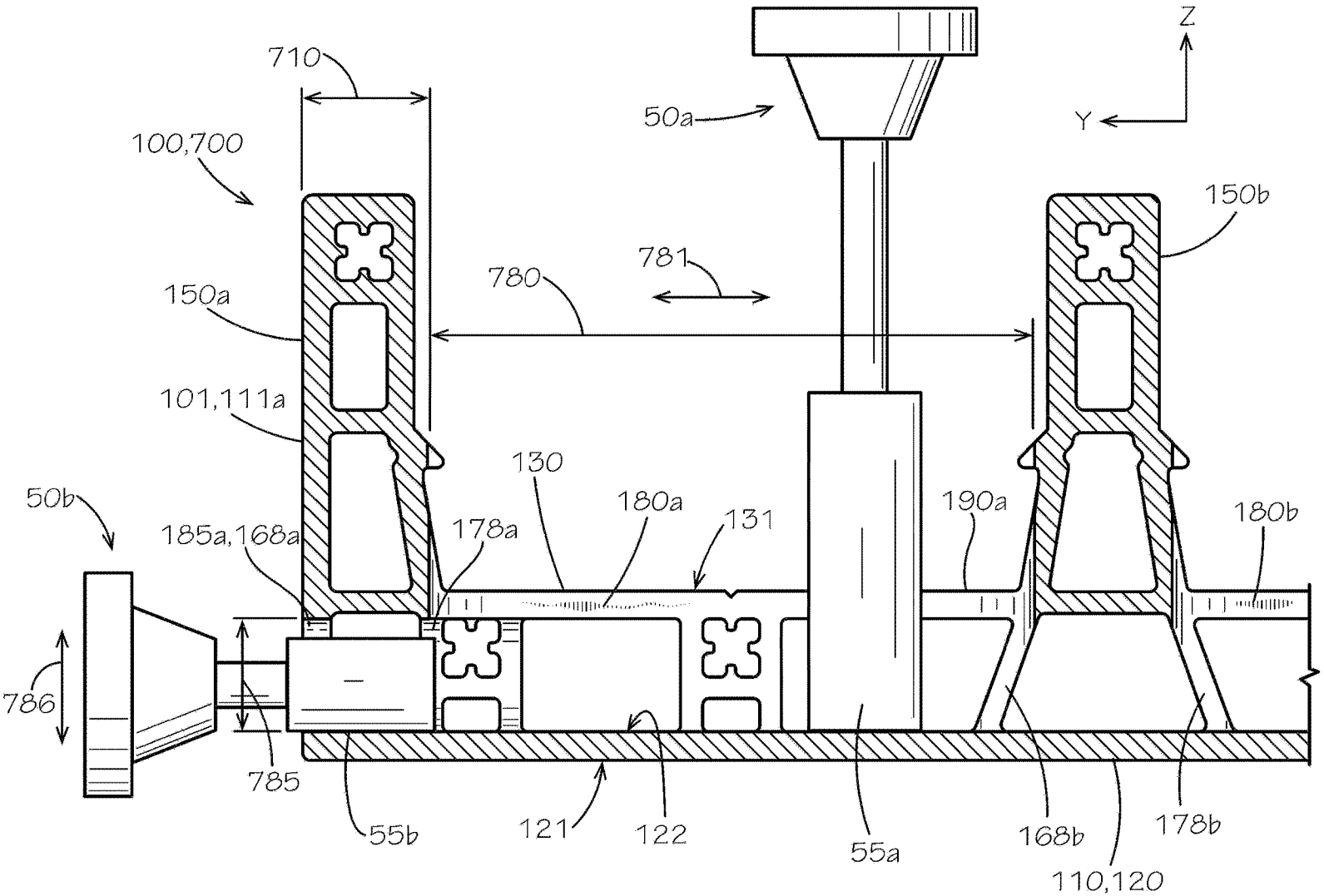
FIG. 7 is a detail sectional view of the door sill of FIG. 1 taken along line 4-4 of FIG. 2, the door sill shown in a process of fabrication in accordance with aspects of the current disclosure.

A method of forming a self-contained weep system 700 in the door sill 100 can comprise forming the door sill 100, which can comprise or define any one or more of the aforementioned features. The method can comprise, as shown in FIG. 7, forming at least one of the openings 180*a,b,c,d,e,f* (180*b,c,d,e,f* shown in FIG. 1) in the upper surface 131 of the top member 130 of the door sill 100. Again, the opening 180*a* can extend from the top member 130 of the sill base 110 to the bottom member 120 of the sill base 110. As shown, forming the opening 180*a* in the door sill 100 can comprise simultaneously (i.e., in the same cutting operation) forming a tower leg opening 178*a* in the second leg 170*a* of the tower 150*a* and forming a tower leg opening 168*b* in the first leg 160*b* of the tower 150*b*. Forming the opening 180*b* in the door sill 100 can comprise simultaneously forming a tower leg opening 178*b* in the second leg 170*b* of the tower 150*b* and a tower leg opening 168*c* (not shown) in the first leg 160*c* of the tower 150*c*, and so forth. Tower leg openings such as, for example and without limitation, the tower leg openings 168*a,b,c,d*, 178*a,b,c,d* can extend to the bottom member 120 of the sill base 110. A tower leg opening at the exterior side 101 such as the tower leg opening 178*a* or a tower leg opening (not shown) at the interior side 102 can correspond to the opening 185*a* and, as shown, need not be formed in the same cutting operation forming the opening 180*a*. In any case, forming the weep system 700 as a self-contained feature of the door sill 100 removes any need for a separate collection pan or sill pan. In referring to the weep system 700 as being self-contained, it is meant that the weep system 700 can be formed together with the door sill 100 as a monolithic component, where "monolithic" means at least to be cast, molded, extruded, or otherwise formed as a single piece.

The method of forming the weep system 700 in the door sill 100 can comprise forming the opening 185*a* in the outer surface 111*a* of the door sill 100. Again, as shown, the opening 185*a* can extend from the outer surface 111*a* towards the opening 180*a* and can intersect the opening 185*a*. As shown and described previously, the opening 185*a* can also extend from the top member 130 of the sill base 110 to the bottom member 120 of the sill base 110. In some aspects, as shown in FIG. 7, the cutting bit 55*b* can form the opening 185*a* merely by extending into the door sill by at least a distance equal to or slightly exceeding a dimension 710 or by otherwise intersecting the opening 180*a* shown by a sufficient amount to remove the material of the door sill 100 that would block movement of water through the door sill 100 as described herein and from the door sill 100 through the opening 185*a*. The dimension 710 can define a distance from the outer surface 111*a* of the door sill 100 to an edge of the opening 180*a* or a width of the corresponding tower 150*a* at the opening 180*a*.

The method of forming the weep system 700 can comprise cutting any of the openings 180*a,b,c,d,e,f* or the openings 185*a,b* with the cutting tool 50*a,b*, only a portion of which is shown in simplified form. The cutting tool 50*a,b* can be oriented vertically or a horizontally or anywhere in between to cut the door sill 100 as desired. In some aspects, as shown, the cutting tool 50*a,b* can cut each of the openings 180*a,b,c,d,e,f* or the openings 185*a,b* as well as all but the tower leg openings 168*a,b,c,d* and the tower leg openings 178*a,b,c,d* closest to a side of the door sill 100 such as, for example and without limitation, the exterior side 101 without repositioning the cutting tool 50*a,b* other than pushing (i.e., plunging) the cutting tool 50*a,b* into or pulling the cutting tool 50*a,b* out of the material of the door sill 100 and translating the cutting tool 50*a,b* in the cutting direction 781, 786. For example and without limitation, the method can comprise plunging a cutting bit 55*a* of the cutting tool 50*a* along the Z-axis direction into the door sill 100 and translating the cutting tool 50*a* in the cutting direction 781 across a cutting swath 780 (which can be measured to the outside of the tool as shown or to a center of the cutting bit of the tool) to form the opening 180*a* as well as the tower leg openings 178*a*, 168*b*. Likewise, the method can comprise plunging a cutting bit 55*b* of the cutting tool 50*b* along the Y-axis direction into the door sill 100 and translating the cutting tool 50*b* in the cutting direction 786 across a cutting swath 785 (which can be measured to the outside of the tool as shown or can be measured to a center of the cutting bit of the tool) to form the opening 185*a*—without any need to form any of the tower leg openings except, in some aspects, as shown, the tower leg openings 168*a*, 178*a*. In some aspects, the method can comprise translating either of the cutting tool 50*a,b* in the X-axis direction or along the longitudinal direction 103 of the door sill 100.

More specifically, the method can comprise forming the second opening 185 in the vertical surface of the door sill 100. The method can comprises cutting the sill base 110 with a cutting bit 55*b* not extending across an entirety of the first opening 180. The method can further comprise forming an upward-facing flat or planar inner surface 122 in the bottom member 120. In some aspects, each portion of the inner surface 122 can be defined by a common plane, and the inner surface 122 can thereby be configured to allow movement or weeping of fluids such as water from inside the door sill 100 without being impeded by raised or lowered portions able to trap the water inside the door sill 100.

In other aspects, the cutting tool 50*a,b* can move in other ways, such as, for example, a multi-axis computer numerical control or CNC tool itself (i.e., not just the cutting bit 55*a,b* of the cutting tool 50*a,b*) can be rotated to cut one or more of the openings including the tower leg openings 168, 178. For example and without limitation, the cutting tool 50*a* could, before or after forming the opening 180*a*, be rotated by 90 degrees or any other desired angle—or the door sill 100 rotated by 90 degrees or any other desired angle—to form the opening 185*a*.

In some aspects, as shown, the cutting bit 55*a,b* can define a flat or squared end. In other aspects, including when the cutting tool 50*a,b* incorporates multi-axis functionality, the cutting bit can define an end having another shape such as one that is, for example and without limitation, ball-shaped or round.

The cutting tool 50*a,b* itself can be manually controlled or can be controlled electronically such as, for example and without limitation, by the aforementioned CNC machine. In some aspects, as shown, the cutting tool 50*a,b* can comprise a respective cutting bit 55*a,b* for removing material from the door sill 100 as desired. In other aspects, the cutting tool 50*a,b* can comprise other structure for removing material from the door sill 100.

A method of using the door system 80 (shown in FIG. 3) can comprise sliding or translating the door 200*a* (shown in FIG. 3) inside the door channel 190*a*. The method of using the door system 80 can comprise receiving moisture (not shown) within the door channel 190*a*. The method of using the door system 80 can comprise weeping, directing, or channeling the moisture within the door channel 190*a* from the door channel 190*a* to within a cavity such as, for example and without limitation, either or both of the cavities 108*a,b* (shown in FIG. 2) of the door sill 100 through, for example and without limitation, the opening 180*a*. The method of using the door system 80 can comprise weeping, directing, or channeling the moisture within such cavities of the door sill 100 to an area outside of the door sill 100 through, for example and without limitation, the opening 185*a*.

In some aspects, the door sill 100 can be formed by extruding a material comprising, for example and without limitation, aluminum or steel. In other aspects, the door sill 100 or portions of the door sill 100 can be formed by another process including, for example and without limitation, an additive manufacturing process. In some aspects, as disclosed throughout, even if secondary processes can be used later to form openings such as the openings 180 and the openings 185, the door sill 100 can nonetheless be formed into a monolithic shape. In contrast to as assembly formed from multiple pieces, a monolithic shape such as the disclosed door sill 100 require no separate fasteners or fastening methods to hold it together, which can add cost and complexity to the door sill 100 and the door system 80.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A door sill comprising:

a sill base comprising a bottom member and a top member defining a cavity therebetween; and a tower extending from the sill base in a vertical direction and defining a bottom end proximate to the bottom member of the sill base and a top end distal from the bottom member of the sill base and offset from the top member of the sill base, the tower comprising a first leg and a second leg, a width of the tower where the tower intersects with the bottom member of the sill base being greater than a width of the tower at the top end, the tower defining a taper angle at a portion of the tower between the top member and the bottom member of the sill base.

2. The door sill of claim 1, wherein the sill base defines a first opening in the top member, the first opening extending from an upper surface of the sill base to the cavity, the tower defining a taper angle sufficiently large for the first opening to intersect an inside surface of at least one of the first leg and the second leg of the tower.

3. The door sill of claim 2, wherein the sill base defines a second opening in the top member, the second opening extending from an outer surface of the sill base to the cavity, the outer surface being angled with respect to the upper surface.

4. The door sill of claim 2, wherein a portion of an inside surface of one of the first leg and the second leg of the tower is offset from an outermost edge of the first opening in a transverse direction of the door sill towards a center of the first opening and relative to the center of the opening.

5. The door sill of claim 4, wherein the portion of the inside surface of the one of the first leg and the second leg of the tower at a position where the one of the first leg and the second leg intersect the bottom member of the sill base is offset from an outermost edge of the opening in a transverse direction of the door sill towards the center of the opening and relative to the center of the opening.

6. The door sill of claim 1, wherein the tower is a first tower, the door sill further comprising a second tower offset in a transverse direction of the door sill from the first tower, the second tower extending from the sill base in a vertical direction and defining a bottom end proximate to the bottom member of the sill base and a top end distal from the bottom member of the sill base and offset from the top member of the sill base, the first tower and the second tower defining a door channel therebetween.

7. The door sill of claim 6, wherein the second tower comprises a first leg and a second leg, a width of the second tower where it intersects with the bottom member of the sill base being greater than a width of the tower at the top end of the second tower.

8. The door will of claim 1, wherein the bottom member of the sill base defines an upward-facing flat inner surface.

9. The door sill of claim 1, wherein the door sill is formed into a monolithic shape.

10. A door system comprising:

a door sill comprising:

a sill base comprising a bottom member and a top member together defining a cavity therebetween;

a first tower extending from the sill base in a vertical direction and defining a bottom end proximate to the bottom member of the sill base and a top end distal from the bottom member of the sill base and offset from the top member of the sill base, the first tower comprising a first leg and a second leg, a width of the first tower where the first tower intersects with the bottom member of the sill base greater than a width of the first tower where the first tower intersects with the top member of the sill base;

a second tower extending from the sill base in a vertical direction and defining a bottom end proximate to the bottom member of the sill base and a top end distal from the bottom member of the sill base, the second tower comprising a first leg and a second leg, a width of the second tower where the second tower intersects with the bottom member of the sill base greater than a width of the second tower where the second tower intersects with the top member of the sill base; and a sliding door positioned between the first tower and the second tower.

11. The door system of claim 10, wherein a bottom end of the sliding door is positioned lower than each of the top end of the first tower and the top end of the second tower, the first tower and the second tower defining a door channel therebetween.

12. The door system of claim 10, wherein the sill base defines a first opening in the top member, the first opening extending from an upper surface of the sill base to the cavity.

13. The door system of claim 12, wherein a portion of an inside surface of one of the first leg and the second leg of the tower is offset from an outermost edge of the first opening in a transverse direction of the door sill towards a center of the first opening and relative to the center of the opening.

14. The door system of claim 12, wherein the sill base defines a second opening in the top member, the second opening extending from an outer surface of the sill base to the cavity, the outer surface being angled with respect to the upper surface.

15. The door system of claim 10, wherein the door sill is formed into a monolithic shape.

16. A method of forming a weep system in a door sill, the method comprising:

forming a door sill comprising:

a sill base comprising a bottom member and a top member together defining a cavity therebetween; and a tower extending from the sill base in a vertical direction and defining a bottom end proximate to the bottom member of the sill base and a top end distal from the bottom member of the sill base and offset from the top member of the sill base, the tower comprising a first leg and a second leg, a width of the tower where the tower intersects with the bottom member of the sill base greater than a width of the tower where the tower intersects with the top member of the sill base; and forming a first opening in a horizontal surface of the door sill, the first opening extending from the top member of the sill base to the bottom member of the sill base.

17. The method of claim 16, wherein forming the first opening in the horizontal surface of the door sill comprises forming a tower leg opening in the first leg of the tower, the tower leg opening extending to the bottom member of the sill base.

18. The method of claim 16, further comprising forming a second opening in a vertical surface of the door sill, the vertical surface defined in an outer surface of the door sill, the second opening extending from the outer surface towards the first opening and intersecting the first opening, the second opening also extending to the bottom member of the sill base.

19. The method of claim 18, wherein forming the second opening in the vertical surface of the door sill comprises cutting the sill base with a cutting bit not extending across an entirety of the first opening.

20. The method of claim 16, further comprising forming an upward-facing flat inner surface in the bottom member.

* * * * *